US005651324A

United States Patent [19]

Arnold

[11] Patent Number: 5,651,324

[45] Date of Patent: Jul. 29, 1997

[54] PROCESS AND DEVICE FOR RECOGNIZING A RESIDUAL AMOUNT OF THE HOOK THREAD IN A SEWING MACHINE

[75] Inventor: Kurt Arnold, Kaiserslautern, Germany

[73] Assignee: G.M. Pfaff Aktiengesellschaft, Kaiserslautern, Germany

[21] Appl. No.: 620,492

[22] Filed: Mar. 22, 1996

[30] Foreign Application Priority Data

Mar. 24, 1995 [DE] Germany ..... 195 10 808.6

[51] Int. Cl.[6] ..... D05B 69/36

[52] U.S. Cl. ..... 112/278

[58] Field of Search ..... 112/278, 273, 112/80.18; 242/37 R, 118.4

[56] References Cited

U.S. PATENT DOCUMENTS

| | | | |
|---|---|---|---|
| 3,845,320 | 10/1974 | Winberg . | |
| 4,196,685 | 4/1980 | Tamura | 112/278 X |
| 5,161,475 | 11/1992 | Tawara et al. | 112/278 |
| 5,211,121 | 5/1993 | Sakakibara | 112/278 |

FOREIGN PATENT DOCUMENTS

| | | | |
|---|---|---|---|
| 4014919 A1 | 11/1990 | Germany | 112/278 |
| 41 16 638 A1 | 11/1991 | Germany . | |
| 40 31 058 C1 | 12/1991 | Germany . | |
| 41 16 788 C1 | 6/1992 | Germany . | |
| 61-232887 | 10/1986 | Japan | 112/278 |
| 3-184593 | 8/1991 | Japan | 112/273 |
| 5-300990 | 11/1993 | Japan | 112/278 |

*Primary Examiner*—Peter Nerbun
*Attorney, Agent, or Firm*—McGlew and Tuttle

[57] ABSTRACT

In a process and device for monitoring a residual amount of hook thread in a double thread lockstitch sewing machine, a bobbin is used, which is divided into a large clamber and a small chamber due to the arrangement of a middle flange, wherein the small chamber accommodates the residual amount of thread. An abrupt reduction in the speed of rotation of the bobbin, $n_S$, takes place dating sewing at the time of the transition from the principal to the residual amount of thread as a consequence of the abrupt change in the thread pull-off site in the bobbin. The jump (abrupt change) in the speed of rotation is measured and is processed info a display signal

5 Claims, 2 Drawing Sheets

PROCESS AND DEVICE FOR RECOGNIZING A RESIDUAL AMOUNT OF THE HOOK THREAD IN A SEWING MACHINE

FIELD OF THE INVENTION

The present invention pertains to a process and a device for recognizing residual thread in sewing machines and more particularly for recognizing a residual amount of hook thread in double lockstitch sewing machines using a bobbin, which has, due to an arrangement of at least one third bobbin flange, at least two chambers which are separated from one another, and wherein one of the chambers is used to accommodate the residual amount of the hook read and has detachable contrast marks on at least one of its flanges.

BACKGROUND OF THE INVENTION

A device on a double thread lockstitch sewing machine for recognizing a residual amount of the hook thread has been known from DE 41 16 638 A1, in which the reaching of the beginning of the residual amount during the pull-off of the hook thread, which takes place during sewing, is recognized from the speed of rotation of the bobbin, which progressively increases with decreasing amount of hook thread, exceeding a predetermined threshold value compared with the speed of rotation of the main shaft of the sewing machine.

Since the rotary movement of the bobbin during sewing is a movement composed of partial movements due to the law governing double lockstitch formation and the stepwise transport of the fabric being sewn, and the bobbin is subject in this connection, especially as a consequence of the jerky pulling in of the stitch by the thread lever, to pulse-like accelerations whose effect on the rotation behavior of the bobbin depends, besides on the stitch length, also on the value and possibly the changes in the speed of rotation of the machine as well as on the coefficient of friction between the bobbin and the bobbin case of the hook, a standardized mean speed of rotation, which would be able to be calculated as a theoretical value from the current speed of rotation of the machine, a defined stitch length and the thickness of the fabric, as well as from the current diameter of the hook thread winding on the bobbin, cannot be inferred from a measured instantaneous speed of rotation of the bobbin. Since the instantaneous speed of rotation of the bobbin oscillates to various extents around the value of the standardized mean speed of rotation, which increases continuously with decreasing amount of hook thread, considerable efforts were made in the prior-art device in terms of signal processing to overcome these inaccuracies. Thus, a mean value is first formed from all speed measured values after the conclusion of a sewing cycle, and this mean value is then compared with the mean value of the preceding sewing cycle to determine a coefficient of change. This calculated value is then compared with a threshold value, which represents the value of the residual amount of thread and is in turn calculated by the computer of the sewing machine on the basis of values entered manually for the stitch length and for the fabric thickness.

A comparatively much more accurate and generally simpler determination of the beginning of a residual amount of hook thread is achieved in the device according to DE 41 16 788 C1 by the amount of residual thread being wound in a desired length in a winding direction that is opposite the winding direction of the amount of the main thread. The direction of rotation of the bobbin changes at the time of the transition from the principle amount to the residual amount of thread, and this change can be unambiguously recognized by measurement and can be subjected to further processing as a signal in a simple manner. However, this advantage is associated with the disadvantage that the usual winding devices, which are sometimes also arranged on the machines, cannot be used to wind thread on the bobbins, bur special left-right bobbin winders are needed.

A device for recognizing a residual amount of hook thread has been known from DE 40 31 058 C1, This device has a bobbin which has, due to the arrangement of at least one third bobbin flange, at least two chambers, which are separated from one another and one of which is used to accommodate the residual amount of thread. The middle flange has a reflecting surface at least on the side facing a reflection head containing a light transmitter and a light receiver. During the winding up of thread, the desired residual amount of thread is first wound up in the rear chamber on the side of the middle flange facing away from the reflecting head, after which the thread is led past the middle flange and the front chamber is then filled.

During sewing, the thread is first pulled out of the front chamber near the end of the unwinding process before the residual amount of thread is pulled off, as a result of which the light beams emitted by the reflecting head are reflected from the middle flange that has become free. The signal generated by the reflected light beams is compared with an adjustable threshold value, and a warning signal is generated when this is exceeded. Depending on the setting of the threshold value, a more or less large residual thread length may now still be present in the front chamber, which is added to the actual residual amount of thread contained m the rear chamber. Since the intensity of the reflected light beams depends not only on the size of the reflecting surface that has become free, but also on its reflectivity bobbins with different degrees of reflection may lead to inaccurate results during the monitoring of the residual thread.

The use of bobbins with two chambers of different size for the purpose of the optoelectric recognition of a residual amount of thread has been known from U.S. Pat. No. 3,845,320 for a long time. All three bobbin flanges are made of a transparent material in one of the three disclosed exemplary embodiments, and the optoelectric recognition device is designed as a transmitted-light photoelectric cell. One of the bobbin flanges is designed as a reflecting surface in the other two exemplary embodiments, while at least one of the other bobbin flanges consists of a transparent material. The recognition device is designed as a reflected-light photoelectric cell in these two exemplary embodiments. There is a risk in all three variants that the reliability of the recognition device is compromised by insufficient transparency or reflectivity of the bobbin flanges as a consequence of contamination or damage to their surfaces.

SUMMARY AND OBJECTS OF THE INVENTION

The basic object of the present invention is to provide a process and a device for recognizing a defined residual amount of hook thread, in which process and device the beginning of the residual amount of thread can be determined in an unambiguous manner without any special technical effort during the pull-off of the hook thread.

According to the invention, a process for recognizing a residual amount of hook thread in a double lockstitch sewing machine is provided including providing a bobbin which has, due to an arrangement of at least one third bobbin flange, at least two bobbin chambers, which are separated from one another. One of the bobbin chambers is used to accommodate a residual amount of hook thread and has detectable contrast marks on at least one of its flanges. The process includes generating signals by scanning the contrast marks wherein the signals are processed into a speed of rotation of the bobbin $n_S$. The speed of rotation of the machine, $n_M$ is determined. The speed of rotation of the bobbin is compared with the speed of rotation of the machine. An abrupt reduction in the speed of rotation of the bobbin, which takes place during the pull-off of the thread at the time of the transition from the principle to the residual amount of thread, is recognized at the time of comparison of the speeds of rotation. A detected jump in the speed of rotation of the bobbin is processed to form a residual thread display, namely an output showing that the residual thread is being used.

The device according to the invention carries out the process as noted above and includes a bobbin which has, due to the arrangement of a third bobbin flange, at least two separate bobbin chambers. The bobbin chambers are separated from one another and one of the bobbin chambers is used to accommodate the principle amount of thread and the other of the bobbin chambers is used to accommodate the residual amount of thread. Specifically, one chamber has a thread ring with residual thread on it whereas an adjacent thread ring has the primary thread thereon (the primary thread may also overlap the residual thread) At least one of the outer flanges has detectable contrast marks. A detector device is provided for detecting the speed of rotation of the bobbin, $n_s$, namely by scanning the contrast marks. Further, a device for detecting the speed of rotation of the machine, $n_M$, is provided. A signal processing device is provided for comparing the speed of rotation of the bobbin with the speed of rotation of the machine and for detecting a jump in the speed of rotation, namely a jump which occurs at a time of transition from the thread ring of the principle amount of thread ring of the residual amount of thread (from the thread chamber accommodating the primary thread to the thread chamber accommodating the residual thread). The signal processing device generates a warning signal. A display unit is provided for receiving the warning signal and for signalling an output of a display corresponding to the existence of the warning signal.

Due to the use of a bobbin (known in itself), which has, due to the arrangement of at least one third bobbin flange, at least two chambers, which are separated from one another and one of which is preferably very small compared with the other one and is used to accommodate the residual amount of thread, the situation arises that an abrupt reduction in the speed of rotation of the bobbin takes place at the time of the transition from the last ring of thread of the principle amount of thread on the bobbin core to the outer, first ring of thread of the residual amount of thread, and this reduction is detectable as a marked jump in the speed of rotation even when a seam with short stitch length and consequently low thread consumption is being formed with the sewing machine rotating at a low speed on a thin fabric. The jump in the speed of rotation can also be clearly distinguished from the step-like speed behavior of the bobbin, which may occur in the case of long stitch lengths because of the high thread consumption per stitch sewn.

If the detectable contrast marks of the bobbin are formed by holes provided in the outer bobbin flanges, the condition of the flange surface or a possible contamination of the bobbin does not affect the reliable detectability of the bobbin rotation, so that the new process and the device used to carry out same leads to an accurate, satisfactory result even if the conditions are difficult in this respect.

The venous features of novelty which characterize the invention are pointed out with particularity in the claims annexed to and forming a part of this disclosure. For a better understanding of the invention, its operating advantages and specific objects attained by its uses, reference is made to the accompanying drawings and description matter in which a preferred embodiment of the invention is illustrated.

DESCRIPTION OF THE PREFERRED EMBODIMENT

Figure 1:
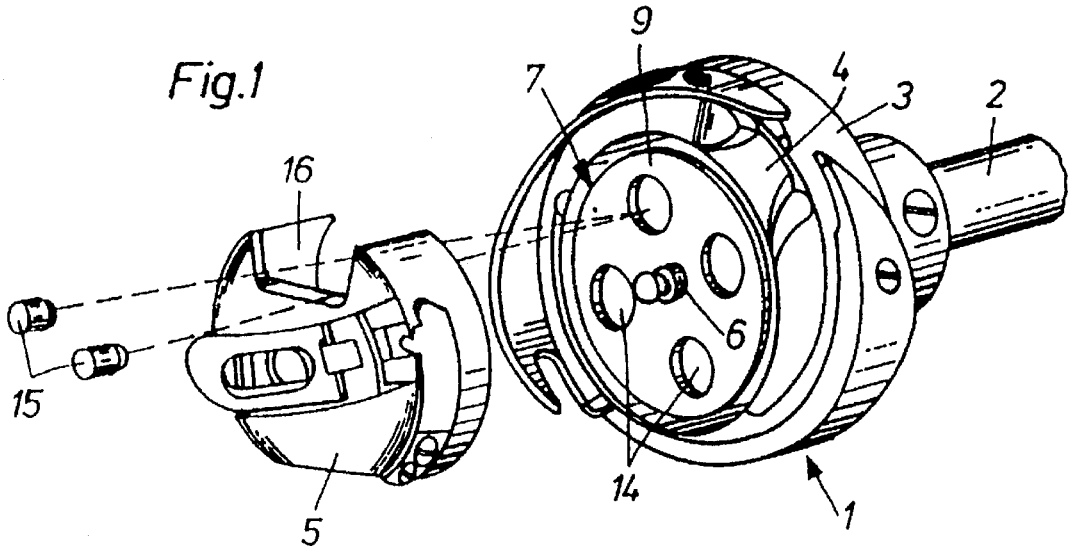
FIG. 1 is an exploded perspective view showing the hook accommodating a bobbin in a sewing machine with a detector device for detecting the speed of rotation of the bobbin.
Figure 3:
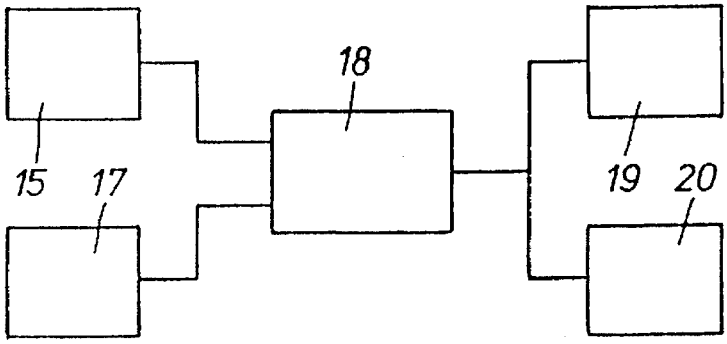
FIG. 3 is a block diagram of the device for recognizing the residual amount of the hook thread.

The hook 1 shown in FIG. 1 is a double-rotating hook for forming double lock stitches. The hook 1 is fastened to the hook drive shaft 2 and comprises, in the known manner, a hook body 3, a lower case 4 rotatably mounted in it, and a removable upper case 5. The lower case 4 carries a middle pin 6 for accommodating a bobbin 7.

The bobbin 7 has a core 8, two outer flanges 9, 10, and a middle flange it, which is mounted between these flanges and whose diameter is smaller than that of the outer flanges 9, 10, and which is located at a much smaller distance from one of the flanges, e.g., 9, than from the other flange 10. A large chamber 12 and a comparatively small chamber 13 are thus formed in the bobbin 7. A plurality of uniformly distributed holes 14, which form detectable contrast marks together with the flange sections located between them, are contained in the outer flanges 9, 10.

A reflected-light photoelectric cell 15, which directs a light beam through an opening 16 of the upper case 5 to the outside of the bobbin flange 9 facing it, is used to detect the rotation of the bobbin. This light beam is reflected to the reflected-light photoelectric cell 15 and is received as a signal only if it reaches (falls on) the flange sections located between the holes 14. However, if it falls into the holes 14, it is diffusely scattered and fails to return as a recordable signal to the reflected-light photoelectric cell 15 even if it also falls upon a thread winding consisting of white yarn.

The sewing machine is also provided with a prior-art device 17 for detecting the speed of rotation of the machine, which is shown only schematically. The signals sent from die reflected-light photoelectric cell 15 15 and the device 17 are subjected to further processing in a signal-processing device 18, e.g., a microcontroller (microprocessor). The signal-processing device 18 is connected to a display unit 19, which is shown schematically, and to the machine control unit 20.

During the filling of an empty bobbin 7, the desired residual amount of thread is first wound up in the small chamber 13. As soon as this chamber is filled, the thread to be wound up jumps into the large chamber 12 and is wound up, beginning from the core 8, to a thread winding filling the remaining bobbin 7, which forms the principle amount of thread of the bobbin 7.

Figure 5:
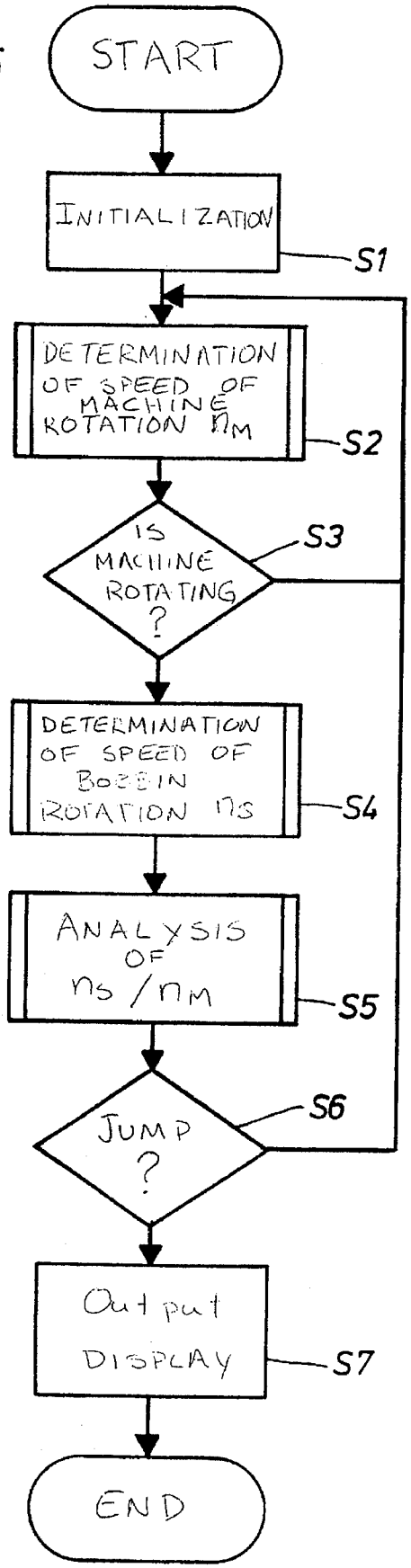
FIG. 5 is a flow chart of the process.
Figure 2:
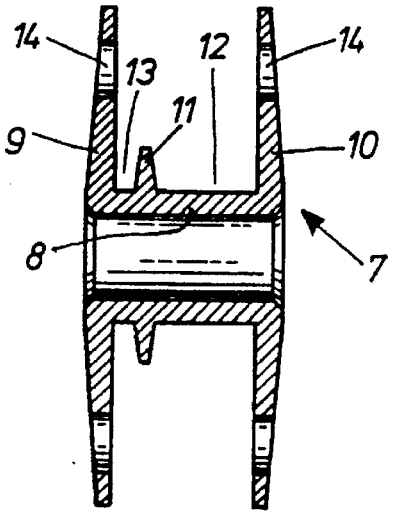
FIG. 2 is a sectional view of a bobbin having three flanges.

The mode of operation of the thread-monitoring device will be described below on the basis of the flow chart shown FIG. 5.

After the machine has been started, the thread-monitoring device is initialized in Step 1. The speed of rotation of the machine, $n_M$, is determined in a subprogram in Step 2 by means of the device 17. The machine is checked to determine whether it is rotating at a branching in Step S3. If it is not rotating, the program jumps back to determine the speed of rotation again at Step S2. If the machine is rotating, the speed of rotation $n_S$ of the bobbin 7 is determined in Step S4 in another subprogram. Since both devices for determining the speed of rotation of the machine and devices for determining the speed of rotation of the bobbin have been known, it is unnecessary to explain these measurement processes, which take place as a subprogram, in greater detail.

After the speed of rotation of the machine, $n_m$, and the speed of rotation of the bobbin, $n_S$, have been determined, the ratio $n_S/n_M$ of these two speed of rotation values is analyzed in a signal-processing device 18 as Step S5.

Figure 4:
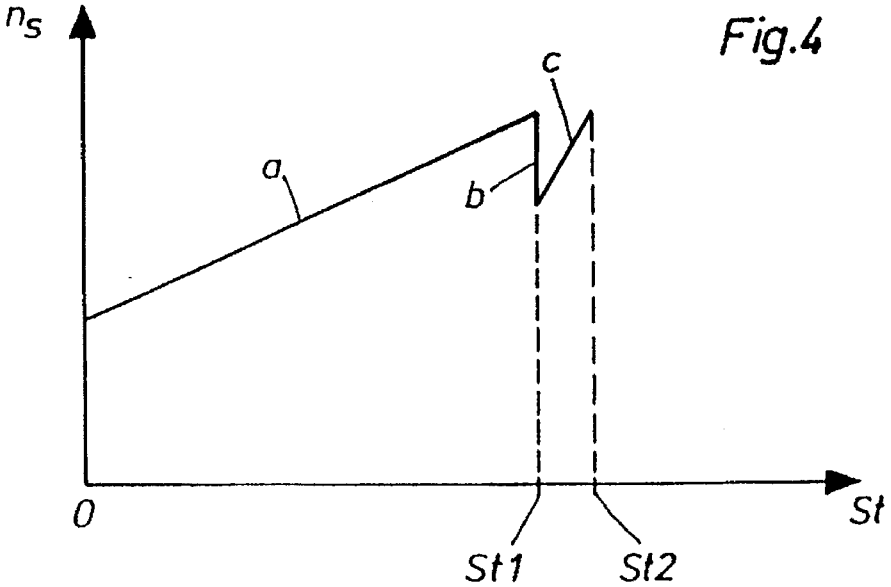
FIG. 4 is a diagram illustrating the changes in the speed of rotation of the bobbin as a function of the number of stitches.

During the pull-off of the hook thread from the bobbin 7, which takes place during sewing as a consequence of the consumption of thread, the speed of rotation $n_S$ of the bobbin will slowly increase during the pull-off of the principle amount of thread with increasing number of stitches St (this is the continuous adding up of the sewing stitches beginning with the first thread pull-off from the bobbin newly inserted into the hook 1) as a consequence of the decreasing diameter of the thread winding, as is shown by the straight line a in the diagram FIG. 4. When the principle amount of thread has been pulled off to the last thread rings on the core 8 and the nearly completely consumed thread winding in the large chamber 12 has shrunk to the smallest possible diameter, the speed of rotation of the bobbin, $n_S$, has reached its maximum relative to the speed of rotation of the machine, $n_M$.

Due to the abrupt radial rise of the thread pull-off site in the bobbin 7 during the transition from the last thread ring of the principle amount of thread located on the core 8 to the outer, first thread ring of the residual amount of thread, a likewise abrupt reduction in the speed of rotation of the bobbin us takes place, which is indicated in FIG. 4 by the vertically dropping straight line b at the stitch number St 1. The further pull-off of the thread during the consumption of the residual amount of thread now begins at a correspondingly lower initial speed of rotation $n_S$. Because of the small width of the small chamber 13, the current diameter of the thread winding of the residual amount of thread decreases much more rapidly than did the diameter of the thread winding of the principle amount of thread before, so that the resulting increase in the speed of rotation of the bobbin, $n_S$, also takes place much more rapidly. This is shown in FIG. 4 by the comparatively steep rise of the straight line c.

The jump in the speed of rotation of the bobbin, $n_S$, which takes place at the beginning of the pull-off of the residual amount of thread, is recognized by the signal-processing device 18 as a signal jump at the time of the evaluation of the speed of rotation ratio $n_S/n_M$, which was determined in Step 5 before, after which "the signal is sent to" the display unit 19 to generate a warning signal. The operator is informed by the display unit 19 lighting up that only the residual amount of thread is now available for further sewing. The value of the residual amount of thread is seen in FIG. 4 as the difference between the number of stitches St 1 at the time of the jump in the speed of rotation and the maximum total number of stitches St 2 that can be reached until the bobbin 7 becomes empty.

With the machine running, a stopping of the bobbin caused by thread break can also be detected by determining the speed of rotation of the bobbin, $n_S$, in the known manner. In this case, the signal-processing device 18 sends a stop signal to the machine control unit 20, and a signal is sent to a display unit indicating the thread break.

While a specific embodiment of the invention has been shown and described in detail to illustrate the application of the principles of the invention, it will be understood that the invention may be embodied otherwise without departing from such principles.

What is claimed is:

1. A process for recognizing a residual amount of hook thread in a double lockstitch sewing machine, comprising:

providing a bobbin with at least two chambers formed by first and second outer flanges and at least one third flange forming a separation between said two chambers, one of said two chambers accommodating a residual amount of hook thread, said bobbin including detectable contrast marks on at least one of said flanges;

scanning said contrast marks to generate a signal;

processing said signal into a speed of rotation of the bobbin signal;

determining a speed of rotation of the sewing machine drive;

comparing a speed of rotation of said bobbin with a speed of rotation of said sewing machine drive;

recognizing an abrupt reduction in speed of rotation of said bobbin, which takes place during a pull-off of thread at a time of transition from a principle amount of thread to a residual amount of thread during said comparison of speeds of rotation; and generating a signal upon said abrupt change in speed of rotation for a residual thread display.

2. A device for a double thread lockstitch sewing machine, comprising:

a bobbin including outer bobbin flanges and an inner bobbin flange defining two separate chambers which are separated from one another by said inner bobbin flange, one of said separate chambers accommodating a residual amount of thread with the other of said chambers accommodating at least a portion of a principle amount of thread, said at least a portion of said principal amount of thread being connected to said residual amount of thread providing a transition from said principal amount of thread at a base of said other of said chambers to said residual amount of thread at a top of said one of said separate chambers, resulting in a change in speed of rotation of said bobbin, at least one of said outer flanges having the detectable contrast mark;

a detector device for detecting a speed of rotation of said bobbin;

a sewing machine speed device for detecting a speed of rotation of said sewing machine;

signal processing means for comparing a speed of rotation of said bobbin with a speed of rotation of said sewing machine for detecting a change in speed of rotation at a time of said transition from said chamber with said principle amount of thread to said chamber with said residual amount of thread and for generating a warning signal; and a display unit for receiving said warning signal and providing a residual thread warning.

3. A device according to claim 2, wherein said display unit produces an audible warning.

4. A device according to claim 2, wherein said display produces a visual warning.

5. A process for recognizing a residual amount of hook thread in a double lockstitch sewing machine, comprising:

providing a bobbin including a principal hook thread chamber and a residual hook thread chamber, said chambers being formed by first and second outer flanges and at least one third flange forming a separation between said chambers said residual hook thread chamber accommodating a residual amount of hook thread and said principal hook thread chamber accommodating at least a portion of a principal amount of hook thread, the principal amount of hook thread being connected to the residual amount of hook thread, the principal amount of hook thread being pulled off first to a bobbin mm of said principal hook thread chamber and the residual amount of hook breed being pulled off after a transition from the principal amount of hook thread to the residual amount of hook thread, said transition including a change in hook thread pulled from said principal hook thread chamber adjacent to said bobbin core to a radially outward location of said residual hook thread chamber whereby a speed of rotation of said bobbin is reduced, said bobbin including detectable contrast marks on at least one of said flanges;

scanning said contrast marks to generate a signal;

processing, said signal into a speed of rotation of he bobbin signal;

determining a speed of rotation of the sewing machine drive;

comparing a speed of rotation of said bobbin with a speed of rotation of said sewing machine drive;

recognizing an abrupt reduction in speed of rotation of said bobbin, which takes place during a pull-off of thread at a dune of said transition from a principle amount of thread to a residual amount of thread during said comparison of speeds of rotation; and generating a signal upon said abrupt change in speed of rotation for a residual thread display.

* * * * *